US010339854B2

(12) United States Patent
Yang et al.

(10) Patent No.: US 10,339,854 B2
(45) Date of Patent: Jul. 2, 2019

(54) IMAGE DISPLAY PANEL AND GATE DRIVING CIRCUIT THEREOF

(71) Applicant: AU OPTRONICS CORPORATION, Hsin-chu (TW)

(72) Inventors: Chuang-Cheng Yang, Hsin-chu (TW); Chun-Feng Lin, Hsin-chu (TW); Ming-Hsien Lee, Hsin-chu (TW); Kai-Wei Hong, Hsin-chu (TW); Chun-Da Tu, Hsin-chu (TW); Yi-Cheng Lin, Hsin-chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 0 days.

(21) Appl. No.: 15/864,498

(22) Filed: Jan. 8, 2018

(65) Prior Publication Data

US 2019/0043412 A1 Feb. 7, 2019

(30) Foreign Application Priority Data

Aug. 2, 2017 (TW) ..... 106126032 A

(51) Int. Cl.
*G09G 3/20* (2006.01)
*G09G 3/36* (2006.01)

(52) U.S. Cl.
CPC ..... *G09G 3/2092* (2013.01); *G09G 3/3677* (2013.01); *G09G 2310/0267* (2013.01);
(Continued)

(58) Field of Classification Search
CPC ..... G09G 3/2092; G09G 2310/0267; G09G 2310/0286; G09G 2310/0289;
(Continued)

(56) References Cited

U.S. PATENT DOCUMENTS 7,215,332 B2 5/2007 Miyazawa
8,422,620 B2 4/2013 Su et al.
(Continued)

FOREIGN PATENT DOCUMENTS

CN 107195276 A 9/2017
TW 567452 B 12/2003
(Continued)

*Primary Examiner* — MD Saiful A Siddiqui
(74) *Attorney, Agent, or Firm* — Tim Tingkang Xia, Esq.; Locke Lord LLP

(57) ABSTRACT

Provided is a gate driving circuit, coupled to a pixel array having multiple gate lines. The gate driving circuit includes multiple shift registers and multiple pull-up transistor, coupled to the pixel array and separately located on two opposite sides of the pixel array. Shift registers located on a same side are sequentially coupled to each other. An $n^{th}$ (n is a positive integer) pull-up transistor includes: a control end, coupled to a control end of a driving transistor of an $(n-1)^{th}$ shift register located on a same side as the $n^{th}$ pull-up transistor; a first end, used to receive a clock signal, where the clock signal is further input to an $n^{th}$ shift register of the shift registers located on an opposite side of the $n^{th}$ pull-up transistor; and a second end, coupled to an $n^{th}$ gate line of the pixel array and used to drive the $n^{th}$ gate line.

8 Claims, 4 Drawing Sheets

(52) U.S. Cl.
CPC ..... *G09G 2310/0286* (2013.01); *G09G 2310/0289* (2013.01); *G09G 2310/08* (2013.01)

(58) Field of Classification Search
CPC ..... G09G 2310/08; G09G 3/3677; G09G 2310/0243; G09G 2310/06; G09G 3/36; G09G 3/3685; G09G 2300/0417; G09G 3/3674; G09G 2330/021
See application file for complete search history.

(56) References Cited

U.S. PATENT DOCUMENTS

| | | | | |
|---|---|---|---|---|
| 8,811,567 | B2 | 8/2014 | Wu et al. | |
| 2006/0007085 | A1* | 1/2006 | Kim | G09G 3/3677 345/87 |
| 2007/0132700 | A1 | 6/2007 | Cho et al. | |
| 2008/0266275 | A1 | 10/2008 | Tsai et al. | |
| 2015/0054562 | A1* | 2/2015 | Pelley | H03K 19/0175 327/333 |
| 2015/0371598 | A1* | 12/2015 | So | G09G 3/20 345/212 |
| 2016/0019976 | A1 | 1/2016 | Pai et al. | |

FOREIGN PATENT DOCUMENTS

| | | | |
|---|---|---|---|
| TW | 200842792 | A | 11/2008 |
| TW | 201112211 | A | 4/2011 |
| TW | 201604852 | A | 2/2016 |

* cited by examiner

IMAGE DISPLAY PANEL AND GATE DRIVING CIRCUIT THEREOF

CROSS-REFERENCE TO RELATED PATENT APPLICATION

This nonprovisional application claims priority to and the benefit of, pursuant to 35 U.S.C. § 119(a), patent application Serial No. 106126032 filed in Taiwan on Aug. 2, 2017. The disclosure of the above application is incorporated herein in its entirety by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference were individually incorporated by reference.

FIELD

The present disclosure relates to an image display panel and a gate driving circuit thereof.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Liquid crystal displays have advantages such as low power consumption and low radiation, and have become a mainstream in the display market. Usually, a display panel of a liquid crystal display includes a plurality of pixels (forming a pixel array), a gate driving circuit, and a source drive circuit. The source drive circuit is used to write a data signal to a switched-on pixel. The gate driving circuit includes shift registers having a plurality of stages, to provide a plurality of gate signals to control the pixels to be turned on or off.

Currently, a narrow-border display panel is of relatively high area utilization, and gains more favor from users. Therefore, one of problems to be resolved in this structure is how to balance area utilization with driving capability of the panel.

SUMMARY

The present disclosure relates to an image display panel and a gate driving circuit thereof. In an architecture of staggered and single-drive shift registers, corresponding pull-up transistors are disposed on opposite sides, to enhance a driving capability of the opposite sides.

According to an embodiment of the present disclosure, a gate driving circuit is provided, coupled to a pixel array. The pixel array includes a plurality of gate lines. The gate driving circuit includes: a plurality of shift registers, coupled to the pixel array, where the shift registers are separately located on two opposite sides of the pixel array, and shift registers located on a same side are sequentially coupled to each other; and a plurality of pull-up transistors, coupled to the pixel array, where the pull-up transistors are separately located on the two opposite sides of the pixel array. An $n^{th}$ (n is a positive integer) pull-up transistor of the pull-up transistors includes: a control end, coupled to a control end of a driving transistor of an $(n-1)^{th}$ shift register that is located on a same side as the $n^{th}$ pull-up transistor and that is of the shift registers; a first end, used to receive a clock signal, where the clock signal is further input to an $n^{th}$ shift register of the shift registers that is located on an opposite side of the $n^{th}$ pull-up transistor; and a second end, coupled to an $n^{th}$ gate line of the pixel array and used to drive the $n^{th}$ gate line.

According to another embodiment of the present disclosure, an image display panel is provided, including: a pixel array, including a plurality of gate lines; and a gate driving circuit, coupled to the pixel array. The gate driving circuit includes: a plurality of shift registers, coupled to the pixel array, where the shift registers are separately located on two opposite sides of the pixel array, and shift registers located on a same side are sequentially coupled to each other; and a plurality of pull-up transistors, coupled to the pixel array, where the pull-up transistors are separately located on the two opposite sides of the pixel array. An $n^{th}$ (n is a positive integer) pull-up transistor of the pull-up transistors includes: a control end, coupled to a control end of a driving transistor of an $(n-1)^{th}$ shift register that is located on a same side as the $n^{th}$ pull-up transistor and that is of the shift registers; a first end, used to receive a clock signal, where the clock signal is further input to an $n^{th}$ shift register of the shift registers that is located on an opposite side of the $n^{th}$ pull-up transistor; and a second end, coupled to an $n^{th}$ gate line of the pixel array and used to drive the $n^{th}$ gate line.

To make the aforementioned and other aspects of the present disclosure more comprehensible, embodiments accompanied with figures are described in detail below.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein.

DETAILED DESCRIPTION

The technical terms in this specification are used with reference to conventional terms in the art. If some terms are described or defined in this specification, explanations of the terms are subject to the description or definition in this specification. Embodiments of the present disclosure respectively have one or more technical features. On the premise of possible implementation, persons of ordinary skill in the art may selectively implement some or all technical features in any one of the embodiments, or selectively combine some or all technical features in the embodiments.

Figure 1:
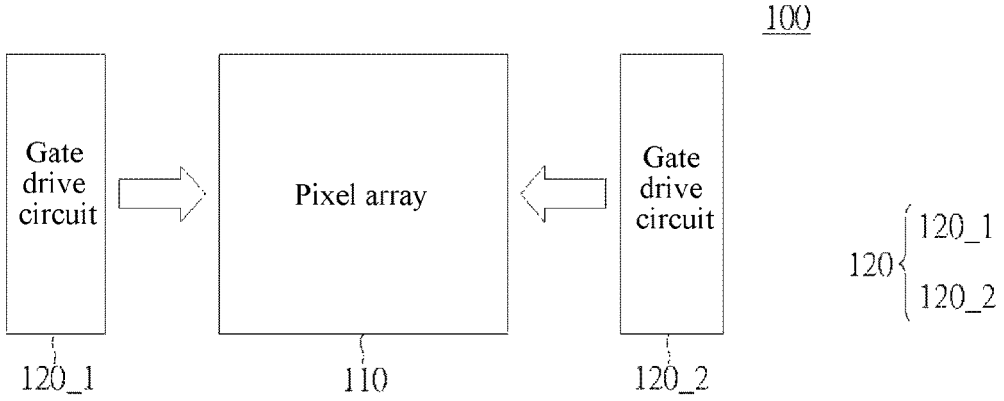
FIG. 1 is a block diagram of a function of an image display panel according to an embodiment of the present disclosure.
Figure 2:
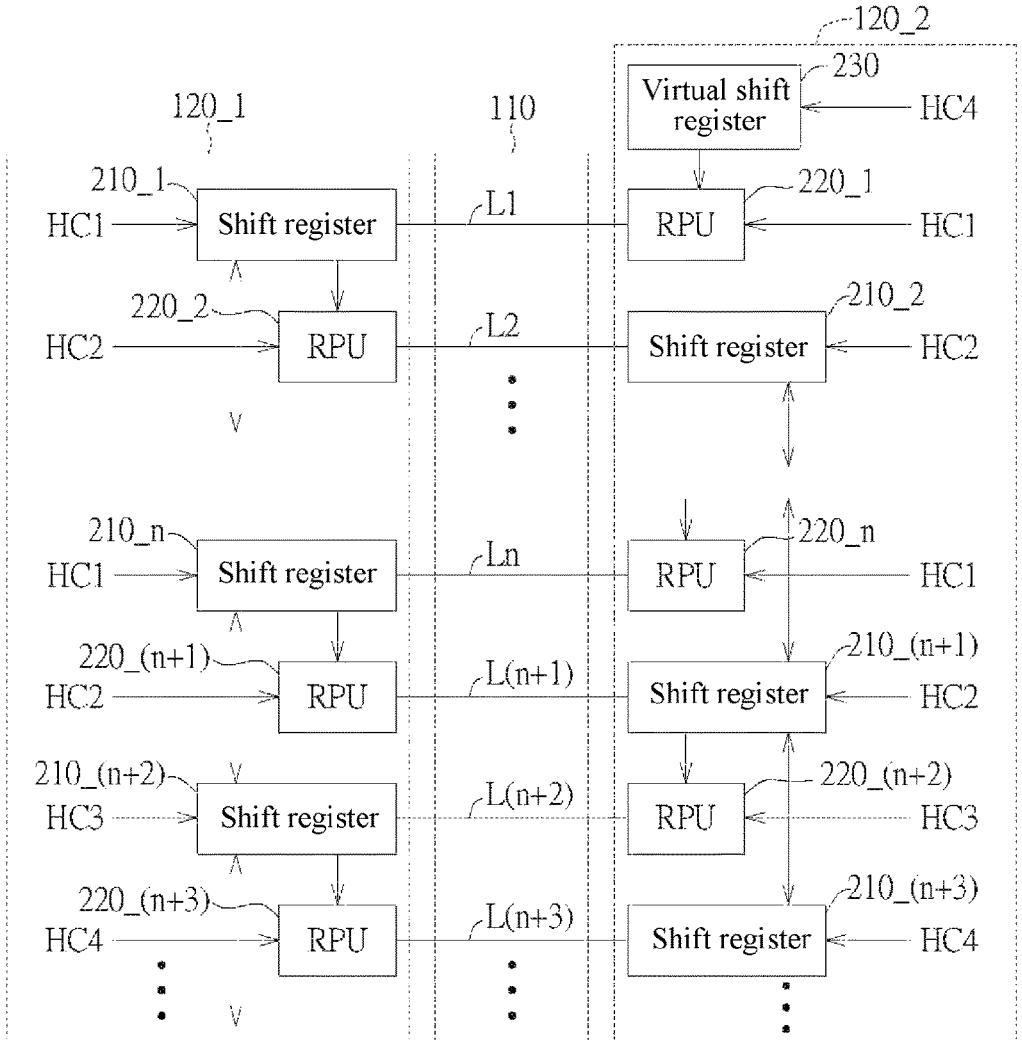
FIG. 2 is a block diagram illustrating in detail an image display panel according to an embodiment of the present disclosure.

Referring to FIG. 1 and FIG. 2, FIG. 1 and FIG. 2 are respectively a block diagram of a function of an image display panel 100 and a block diagram illustrating in detail the image display panel 100 according to an embodiment of the present disclosure. As shown in FIG. 1 and FIG. 2, the image display panel 100 includes: a pixel array 110, including a plurality of gate lines L1 to L(n+3); and a gate driving circuit 120, coupled to the pixel array 110. The gate driving circuit 120 includes a left-side gate driving circuit 120_1 and a right-side gate driving circuit 120_2.

The gate driving circuit 120 includes: a plurality of shift registers 210_1 to 210_(*n*+3) (n is a positive integer), and a plurality of RPUs 220_1 to 220_(*n*+3).

The shift registers 210_1 to 210_(*n*+3) are coupled to the pixel array 110. The shift registers 210_1 to 210_(*n*+3) are separately located on opposite sides (for example but not limited to, a right side and a left side) of the pixel array 110. The shift registers 210_1 to 210_(*n*+3) located on a same side are sequentially coupled to each other.

The pull-up transistors (RPUs) 220_1 to 220_(*n*+3) are coupled to the pixel array 110 and the shift registers 210_1 to 210_(*n*+3). The pull-up transistors are separately located on the two opposite sides of the pixel array.

As shown in FIG. 2, the left-side gate driving circuit 120_1 includes shift registers 210_1, 210_3 (not shown), . . . , 210_*n*, and 210_(*n*+2) of odd-numbered stages, and pull-up transistors 220_2, 220_4 (not shown), . . . , 220_(*n*+1), and 220_(*n*+3) of even-numbered stages. The right-side gate driving circuit 120_1 includes shift registers 210_2, 210_4 (not shown), . . . , 210_(*n*+1), and 210_(*n*+3) of even-numbered stages, and pull-up transistors 220_1, 220_3 (not shown), . . . , 220_*n*, and 220_(*n*+2) of odd-numbered stages.

The shift registers located on a same side are coupled to each other, and transmit signals sequentially to each other. For example, on the left side, the shift registers 210_1, 210_3 (not shown), . . . , 210_*n*, and 210_(*n*+2) of odd-numbered stages are sequentially coupled to each other, and transmit scanning signals to each other. Similarly, on the right side, the shift registers 210_2, 210_4 (not shown), . . . , 210_(*n*+1), and 210_(*n*+3) of even-numbered stages are sequentially coupled to each other, and transmit scanning signals to each other.

In addition, the gate driving circuit 120 includes a virtual shift register 230. The virtual shift register 230 is used to provide a required signal to the pull-up transistor 220_1 of a first stage, and receive a clock signal HC4.

Figure 3A:
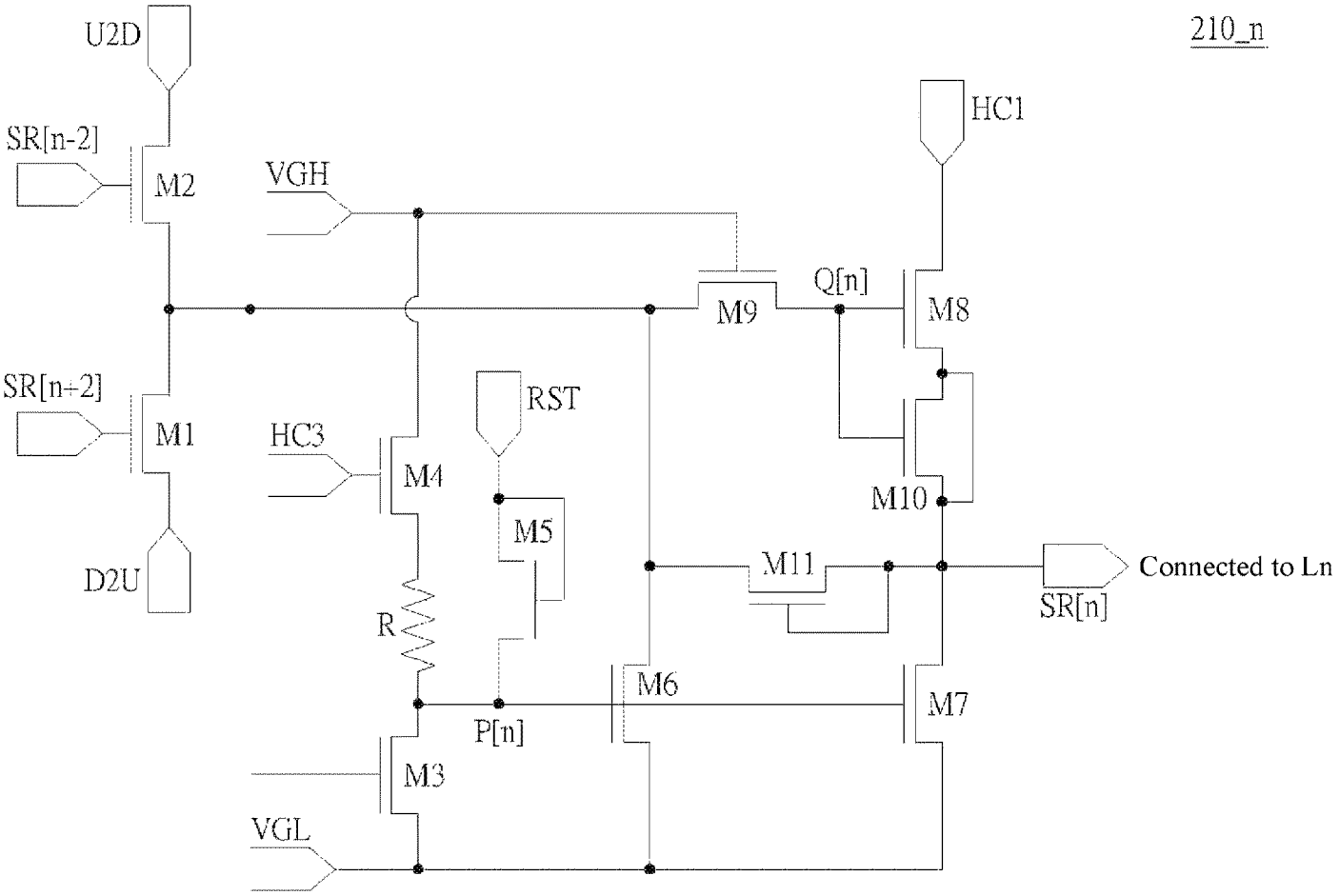
FIG. 3A is a diagram of a circuit architecture of a shift register according to an embodiment of the present disclosure.

FIG. 3A is a diagram of a circuit architecture of a shift register according to an embodiment of the present disclosure. In FIG. 3A, the (left-side) shift register 210_*n* is used as an example for description. As shown in FIG. 3A, the shift register 210_*n* according to this embodiment of the present disclosure includes: transistors M1 to M11 and a resistor R.

The transistors M1 and M2 form an input stage circuit. The transistor M1 has a control end (for example, a gate), a first end (for example, a source), and a second end (for example, a drain). The transistor M2 has a control end, a first end, and a second end. The control end of the transistor M1 is used to receive a scanning signal SR[n+2] of a stage after a next stage, and the control end of the transistor M2 is used to receive a scanning signal SR[n−2] of a stage before a previous stage. The first end of the transistor M1 receives a scanning direction signal D2U. The first end of the transistor M2 receives a scanning direction signal U2D. The second end of the transistor M1 and the second end of the transistor M2 are coupled to a control end of the driving transistor M8 by means of the transistor M9.

The transistors M3 to M7 form a pull-down circuit. The pull-down circuit is coupled to the driving transistor M8, and is used to pull down a scanning control signal Q[n] of the current stage and a scanning signal SR[n] of the current stage. The pull-down circuit includes: a voltage dividing circuit (including the transistor M3, the resistor R, and the transistor M4), the reset transistor M5, a first pull-down transistor M6, and a second pull-down transistor M7.

The voltage dividing circuit is used to generate a pull-down voltage P[n] according to a high-level voltage VGH and/or a low-level voltage VGL. That is, the voltage dividing circuit performs voltage division on the high-level voltage VGH and/or the low-level voltage VGL, to generate the pull-down voltage P[n].

In the voltage dividing circuit, the first voltage dividing transistor M3 has a control end, a first end, and a second end. The control end of the first voltage dividing transistor M3 is coupled to a gate (that is, a scanning control signal Q[n] of the current stage) of the driving transistor M8 by means of the transistor M9. The first end of the first voltage dividing transistor M3 is coupled to the low-level voltage VGL, and the second end of the first voltage dividing transistor M3 is coupled to the pull-down voltage P[n].

In the voltage dividing circuit, the second voltage dividing transistor M4 has a control end coupled to a clock signal HC3 (a phase difference between HC1 and HC3 is 180 degrees), a first end coupled to the high-level voltage VGH, and a second end coupled to the pull-down voltage P[n].

After the voltage division, if a potential of the pull-down voltage P[n] is close to the high-level voltage VGH, the transistors M6 and M7 are turned on, so that the scanning control signal Q[n] of the current stage and the scanning signal SR[n] of the current stage are pulled down. Conversely, after the voltage division, if a potential of the pull-down voltage P[n] is close to the low-level voltage VGL, the transistors M6 and M7 are turned off, so that the scanning control signal Q[n] of the current stage and the scanning signal SR[n] of the current stage are not pulled down.

The reset transistor M5 is coupled to the first and second pull-down transistors M6 and M7. The reset transistor M5 resets the pull-down voltage P[n] in response to a reset signal RST. In addition, in response to the resetting of the pull-down voltage P[n], the first pull-down transistor M6 is turned on to reset the scanning control signal Q[n] of the current stage; and the second pull-down transistor M7 is turned on to reset the scanning signal SR[n] of the current stage.

The first pull-down transistor M6 is coupled to the voltage dividing circuit, and determines, according to the pull-down voltage P[n], whether to pull down the scanning control signal Q[n] of the current stage. After the voltage division, if the potential of the pull-down voltage P[n] is close to the high-level voltage VGH, the transistor M6 is turned on, so that the scanning control signal Q[n] of the current stage is pulled down. Conversely, if the potential of the pull-down voltage P[n] is close to the low-level voltage VGL, the transistor M6 is turned off, and the scanning control signal Q[n] of the current stage is not pulled down.

The second pull-down transistor M7 is coupled to the voltage dividing circuit, and determines, according to the pull-down voltage P[n], whether to pull down the scanning signal SR[n] of the current stage. When the potential of the pull-down voltage P[n] is close to the high-level voltage VGH, the transistor M7 is turned on, and the scanning signal SR[n] of the current stage is pulled down. Conversely, if the potential of the pull-down voltage P[n] is close to the low-level voltage VGL, the transistor M7 is turned off, and the scanning signal SR[n] is not pulled down.

The driving transistor M8 has the control end for receiving the scanning control signal Q[n] of the current stage, a first end for receiving the clock signal HC1, and a second end for outputting the scanning signal SR[n] of the current stage. The scanning signal SR[n] of the current stage is output to a gate line Ln of the current stage, to drive the gate line Ln of the current stage. As shown in FIG. 2, the shift registers 210_1, 210_3 (not shown), . . . , **210_*n*, and 210_(*n*+2) of odd-numbered stages separately receive the clock signal HC1 or HC3, and the shift registers 210_2, 210_4 (not shown), . . . , 210_(*n*+1), and 210_(*n*+3) of even-numbered stages separately receive a clock signal HC2 or HC4. In addition, the pull-up transistors 220_2, 220_4 (not shown), . . . , 220_(*n*+1), and 220_(*n*+3) of even-numbered stages separately receive the clock signal HC2 or HC4, and the pull-up transistors 220_1, 220_3 (not shown), . . . , 220_*n*, and 220_(*n*+2)** of odd-numbered stages separately receive the clock signal HC1 or HC3.

The transistor M9 is used to reduce a leakage current of the transistor M1 and a leakage current of the transistor M2. A control end of the transistor M9 is coupled to the high-level voltage VGH, a first end of the transistor M9 is coupled to the gate of the transistor M8, and a second end of the transistor M9 is coupled to the second end of the transistor M1 and the second end of the transistor M2. In a forward scanning mode, when the scanning control signal Q[n] of the current stage is logic high (for example, close to VGH), and afterward, the clock signal HC1 connected to the first end of the transistor M8 increases from VGL to VGH, the scanning control signal Q[n] of the current stage is coupled to a voltage level higher than VGH (the voltage level is VGH+), and the transistor M1 is turned off (the signal D2U in this case is VGL). If there is no transistor M9, VDS (a voltage across the drain and the source) of the transistor M1 is greater than a sum of absolute values of VGH and VGL, resulting in a relatively high leakage current. Therefore, by means of the transistor M9, VDS of the transistor M1 can be reduced, and the leakage current of the transistor M1 is further reduced.

Similarly, in a backward scanning mode, when the scanning control signal Q[n] of the current stage is logic high (for example, close to VGH), and afterward, the clock signal HC1 connected to the first end of the transistor M8 increases from VGL to VGH, the scanning control signal Q[n] of the current stage is coupled to a voltage level higher than VGH (the voltage level is VGH+), and the transistor M2 is turned off (the signal U2D in this case is VGL). If there is no transistor M9, VDS (a voltage across the drain and source) of the transistor M2 is greater than a sum of absolute values of VGH and VGL, resulting in a relatively high leakage current. Therefore, by means of the transistor M9, VDS of the transistor M2 can be reduced, and the leakage current of the transistor M2 is further reduced.

The transistor M10 forms a capacitor coupled to the driving transistor, to maintain the scanning control signal Q[n] of the current stage. In detail, a gate of the transistor M10 is coupled to the scanning control signal Q[n] of the current stage, and a first end and a second end of the transistor M10 are coupled to each other. The first end is coupled to the transistor M8, and the second end is coupled to the scanning signal SR[n] of the current stage.

A first end of the transistor M11 is coupled to the second end of the transistor M1 and the second end of the transistor M2, and a second end and a control end of the transistor M11 are both coupled to the scanning signal SR[n] of the current stage. When the scanning control signal Q[n] is at the voltage level VGH+, the scanning signal SR[n] of the current stage coupled to the second end of the transistor M11 is at the VGH level. In this case, the control end and the second end of the transistor M11 are coupled to the VGH level, and the transistor M11 is turned on. Leakage currents between the scanning control signal Q[n] of the current stage and the coupled transistors are compensated, to maintain the voltage level of the scanning control signal Q[n] of the current stage.

Figure 3B:
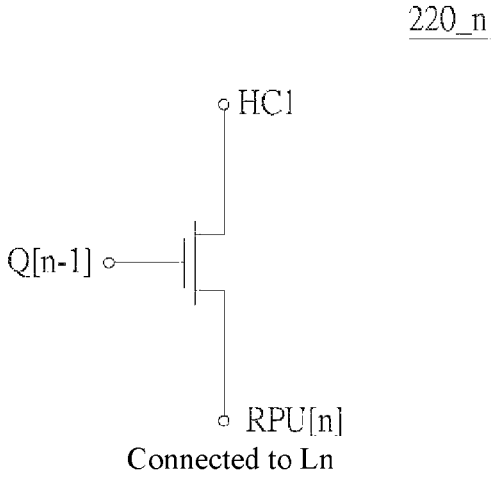
FIG. 3B is a diagram of a coupling relationship of a pull-up transistor according to an embodiment of the present disclosure.

FIG. 3B is a diagram of a coupling relationship of a pull-up transistor according to an embodiment of the present disclosure. In FIG. 3B, the (right-side) pull-up transistor **220_*n* is used as an example for description. As shown in FIG. 3B, the pull-up transistor 220_*n* according to this embodiment of the present disclosure includes: a control end, coupled to a control end Q[n−1] of a driving transistor (M8) of an $(n-1)^{th}$ shift register 210_(*n*−1) that is located on a same side as the pull-up transistor 220_*n* and that is of the shift registers; a first end, coupled to a clock signal HC1, where the clock signal HC1 is input to an $n^{th}$ shift register 210_*n* that is located on an opposite side of the pull-up transistor 220_*n* and that is of the shift registers; and a second end, coupled to an $n^{th}$ gate line Ln of the pixel array 110 and used to drive an $n^{th}$ gate line Ln. That is, a gate of the pull-up transistor 220_*n* is coupled to a scanning control signal Q[n−1] of the $(n-1)^{th}$ shift register 210_(*n*−1) of a previous stage, a drain of the pull-up transistor 220_*n* and a drain of a driving transistor M8 of the $n^{th}$ shift register 210_*n* of a same stage as the pull-up transistor 220_*n* receive a same clock signal (HC1), and a source of the pull-up transistor 220_*n*** outputs a pull-up signal RPU[n], to drive the gate line Ln of the current stage. In addition, a size of the pull-up transistor is at least five times a size of a smallest transistor among the shift registers. Therefore, the pull-up transistor may have a sufficient driving capability.

In this embodiment of the present disclosure, a first end of an $n^{th}$ pull-up transistor (n is a positive integer) of the pull-up transistors receives a clock signal (for example, HC1 in FIG. 3B). The clock signal is further input to the drain of the driving transistor M8 of the $n^{th}$ shift register that is located on the opposite side of the $n^{th}$ pull-up transistor and that is of the shift registers. Clock signals received by first ends of the pull-up transistors may be clock signals having (2m+2) groups of (m is a positive integer, and t m=1 in this embodiment, but this is not limited in the present disclosure) phases. The (2m+2) groups of clock signals are sequentially and circularly input to drains of driving transistors M8 of the shift registers (n is generally far greater than (2m+2)), as shown in FIG. 2.

Therefore, a pull-up transistor at a far end may also drive a gate line of a same stage as the pull-up transistor, to enhance a driving capability without greatly increasing a circuit area. In this specification of the present disclosure, a near end is a shift register of the stage, and the far end is a pull-up transistor of the same stage as the shift register. Therefore, using an $n^{th}$ stage as an example, a left-side shift register **210_*n* is referred to as a near end, and a right-side pull-up transistor 220_*n* is referred to as a far end. Similarly, using an $(n+1)^{th}$ stage as an example, a right-side shift register 210_($n$+1) is referred to as a near end, and a left-side pull-up transistor 220**_($n$+1) is referred to as a far end.

Figure 4:
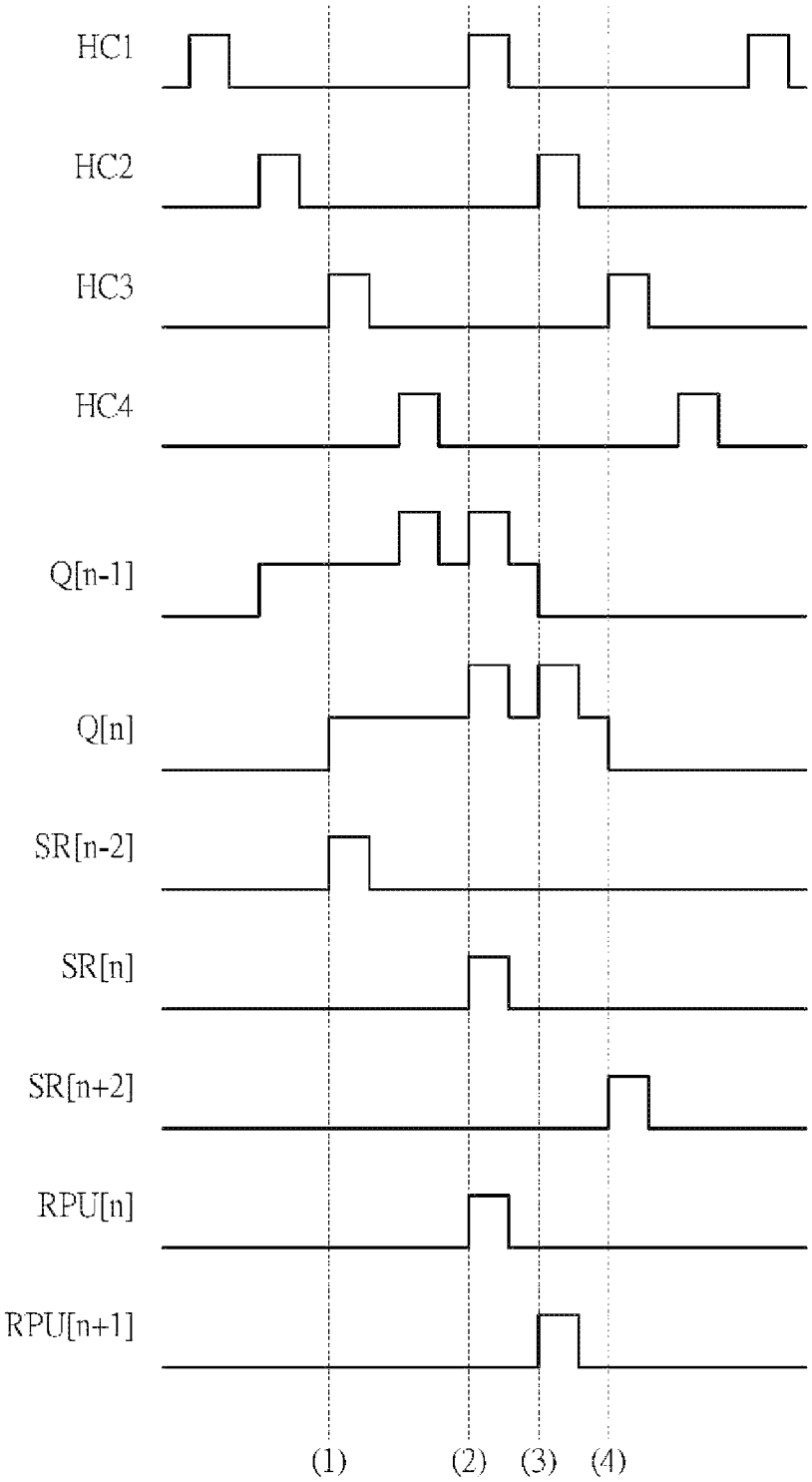
FIG. 4 is a signal sequence diagram of a gate driving circuit according to an embodiment of the present disclosure.

The following describes how a gate driving circuit operates according to an embodiment of the present disclosure. FIG. 4 is a signal sequence diagram of the gate driving circuit according to an embodiment of the present disclosure. A case (1) in FIG. 4 shows a signal sequence diagram of charging, in a first phase, a scanning control signal Q[n] of the current stage. A case (2) in FIG. 4 shows a signal sequence diagram of charging, in a second phase, the scanning control signal Q[n] of the current stage, and charging a scanning signal SR[n] of the current stage. A case (3) in FIG. 4 shows a signal sequence diagram of charging, in the second phase, the scanning control signal Q[n] of the current stage, and charging a scanning signal RPU[n+1] of a next stage. A case (4) in FIG. 4 shows a signal sequence diagram of discharging the scanning control signal Q[n] of the current stage, and discharging the scanning signal SR[n] of the current stage.

In the case (1) in FIG. 4, when the scanning control signal Q[n] of the current stage is charged in the first phase, because a scanning signal SR[n−2] is of a high potential and a scanning signal SR[n+2] is of a low potential, the transistor M1 is turned off and the transistor M2 is turned on. Because the control end of the transistor M9 is connected to VGH, the transistor M9 is turned on. The transistors M2 and M9 are turned on, so that the scanning control signal Q[n] of the current stage is pulled up to VGH (because a signal U2D is VGH in this case). In addition, in this case, the transistor M8 is turned on to discharge the scanning signal SR[n] of the current stage (HC1 is VGL). In addition, the transistor M4 is turned on (HC3 is VGH) and the transistor M3 is also turned on (the transistor M2 outputs VGH to the control end of the transistor M3), so that a pull-down voltage P[n] is close to a low potential. Therefore, the transistors M6 and M7 are turned off.

In the case (2) in FIG. 4, when the scanning control signal Q[n] of the current stage is charged in the second phase and the scanning signal SR[n] of the current stage is charged, because the scanning control signal Q[n] of the current stage is logic high (for example, close to VGH), when a clock signal HC1 connected to the first end of the transistor M8 increases from VGL to VGH, the transistor M8 is turned on to charge the scanning signal SR[n] of the current stage. In addition, the scanning control signal Q[n] of the current stage is coupled to a voltage level higher than VGH (the voltage level is VGH+, and this is the "charging the scanning control signal Q[n] of the current stage in the second phase"). In addition, in this case, a scanning control signal Q[n−1] of a previous stage is logic high, and the clock signal HC1 connected to the first end of the pull-up transistor 220_$n$ increases from VGL to VGH, so that the pull-up transistor 220_$n$ is turned on to output a pull-up signal RPU[n] having a high logic level to drive a gate line Ln of the current stage. In addition, a scanning control signal Q[n−1] of the previous stage is coupled to a voltage level higher than VGH (the voltage level is VGH+ (not shown in the figure)). When charging on the scanning signal SR[n] of the current stage is completed, and the clock signal HC1 connected to the first end of the transistor M8 decreases from VGH to VGL, the scanning control signal Q[n] of the current stage is coupled to be close to a VGH level from VGH+, and the scanning signal SR[n] of the current stage is discharged to VGL. In addition, when charging on the pull-up signal RPU[n] is completed, and the clock signal HC1 connected to the first end of the pull-up transistor 220_$n$ decreases from VGH to VGL, the scanning control signal Q[n−1] of the previous stage is coupled to be close to a VGH level from VGH+, and the pull-up signal RPU[n] is discharged to VGL.

In the case (3) in FIG. 4, when the scanning control signal Q[n] of the current stage is charged in the second phase and a scanning signal RPU[n+1] of the next stage is charged, because the scanning control signal Q[n] of the current stage that is connected to the control end of the transistor 220_($n$+1) is logic high (for example, close to VGH), when a clock signal HC2 connected to the first end of the transistor 220_($n$+1) increases from VGL to VGH, the transistor 220_($n$+1) is turned on to charge the pull-up scanning signal RPU[n+1] of the next stage and drive a gate line L(n+1) of the next stage. In addition, the scanning control signal Q[n] of the current stage is coupled to be a voltage level (the voltage level is VGH+) higher than VGH. When charging on the pull-up scanning signal RPU[n+1] of the next stage is completed, and the clock signal HC2 connected to the first end of the pull-up transistor 220_($n$+1) decreases from VGH to VGL, the scanning control signal Q[n] of the current stage is coupled to be close to a VGH level from VGH+, and the pull-up scanning signal RPU[n+1] of the next stage is discharged to VGL.

In the case (4) in FIG. 4, when the scanning control signal Q[n] of the current stage is discharged and the scanning signal SR[n] of the current stage is discharged, because a scanning signal SR[n−2] is of a low potential and a scanning signal SR[n+2] is of a high potential, the transistor M1 is turned on and the transistor M2 is turned off (a signal D2U is of a low potential VGL in this case), so that the scanning control signal Q[n] of the current stage is pulled down to VGL (because the signal D2U is VGL in this case). In addition, because the transistor M4 is turned on (HC3 is VGH) and the transistor M3 is turned off (Q[n] is pulled down to VGL), a pull-down voltage P[n] is close to a high potential. Therefore, the transistors M6 and M7 are turned on to discharge the scanning control signal Q[n] of the current stage and the scanning signal SR[n] of the current stage to the low potential VGL.

In conclusion, in the foregoing embodiments of the present disclosure, the gate driving circuit is designed to be simple (in an architecture of staggered and single-drive shift registers). Therefore, there is a relatively small quantity of transistors, thereby reducing manufacturing costs. In addition, although the architecture of staggered and single-drive shift registers is used, pull-up transistors are disposed on opposite sides. Therefore, driving capabilities of the opposite sides are enhanced without excessively increasing a circuit area, facilitating a design of a narrow-border panel.

In conclusion, the present disclosure is disclosed by using the embodiments; however, the embodiments are not intended to limit the present disclosure. Persons of ordinary skills in the art to which the present disclosure belongs can make various variations and modifications without departing from the spirit and scope of the present disclosure. Therefore, the protection scope of the present disclosure shall be subject to the appended claims.

What is claimed is:

1. A gate driving circuit, coupled to a pixel array, wherein the pixel array comprises a plurality of gate lines, and the gate driving circuit comprises:

a plurality of shift registers, coupled to the pixel array, wherein the shift registers are separately located on two opposite sides of the pixel array, and shift registers located on a same side are sequentially coupled to each other;

a plurality of pull-up transistors, coupled to the pixel array, wherein the pull-up transistors are separately located on the two opposite sides of the pixel array, wherein an $n^{th}$ pull-up transistor of the pull-up transistors comprises:

a control end, directly and electrically coupled to a control end of a driving transistor of an $(n-1)^{th}$ shift register that is located on a same side as the $n^{th}$ pull-up transistor;

a first end, used to receive a clock signal, wherein the clock signal is further input to an $n^{th}$ shift register of the shift registers that is located on an opposite side of the $n^{th}$ pull-up transistor; and a second end, coupled to an $n^{th}$ gate line of the pixel array and used to drive the $n^{th}$ gate line, wherein n is a positive integer greater than one; and a virtual shift register, coupled to a first pull-up transistor of the pull-up transistors, wherein the virtual shift register is used to provide a required signal to one of the pull-up transistors.

2. The gate driving circuit according to claim 1, wherein a driving transistor of each shift register outputs a scanning signal.

3. The gate driving circuit according to claim 1, wherein a size of the pull-up transistor is at least five times a size of a smallest transistor among the shift registers.

4. The gate driving circuit according to claim 1, wherein first ends of the pull-up transistors separately receive clock signals having (2m+2) groups of phases, m is a positive integer greater than or equal to one, and the (2m+2) groups of clock signals are sequentially and circularly input to the shift registers.

5. An image display panel, comprising:

a pixel array, comprising a plurality of gate lines; and a gate driving circuit, coupled to the pixel array, wherein the gate driving circuit comprises:

a plurality of shift registers, coupled to the pixel array, wherein the shift registers are separately located on two opposite sides of the pixel array, and shift registers located on a same side are sequentially coupled to each other;

a plurality of pull-up transistors, coupled to the pixel array, wherein the pull-up transistors are separately located on the two opposite sides of the pixel array, wherein an $n^{th}$ pull-up transistor of the pull-up transistors comprises:

a control end, directly and electrically coupled to a control end of a driving transistor of an $(n-1)^{th}$ shift register that is located on a same side as the $n^{th}$ pull-up transistor;

a first end, used to receive a clock signal, wherein the clock signal is further input to an $n^{th}$ shift register of the shift registers that is located on an opposite side of the $n^{th}$ pull-up transistor; and a second end, coupled to an $n^{th}$ gate line of the pixel array and used to drive the $n^{th}$ gate line, wherein n is a positive integer greater than one; and a virtual shift register, coupled to a first pull-up transistor of the pull-up transistors, wherein the virtual shift register is used to provide a required signal to one of the pull-up transistors.

6. The image display panel according to claim 5, wherein a driving transistor of each shift register outputs a scanning signal.

7. The image display panel according to claim 5, wherein a size of the pull-up transistor is at least five times a size of a smallest transistor among the shift registers.

8. The image display panel according to claim 5, wherein first ends of the pull-up transistors separately receive clock signals having (2m+2) groups of phases, m is a positive integer greater than or equal to one, and the (2m+2) groups of clock signals are sequentially and circularly input to the shift registers.

* * * * *